US009165725B2

(12) United States Patent
Liu et al.

(10) Patent No.: US 9,165,725 B2
(45) Date of Patent: Oct. 20, 2015

(54) OFF-CIRCUIT TAP CHANGER

(71) Applicant: WUHAN TAIPU TRANSFORMER CHANGER CO., LTD., Wuhan (CN)

(72) Inventors: Gang Liu, Wuhan (CN); Zhi-Biao Ding, Wuhan (CN); Zhi-Jiang Xu, Wuhan (CN)

(73) Assignee: WUHAN TAIPU TRANSFORMER CHANGER CO., LTD., Wuhan (CN)

( * ) Notice: Subject to any disclaimer, the term of this patent is extended or adjusted under 35 U.S.C. 154(b) by 256 days.

(21) Appl. No.: 13/908,671

(22) Filed: Jun. 3, 2013

(65) Prior Publication Data

US 2013/0327619 A1 Dec. 12, 2013

(30) Foreign Application Priority Data

Jun. 6, 2012 (CN) ..... 2012 1 0182846

(51) Int. Cl.

| | |
|---|---|
| ***H01H 19/00*** | (2006.01) |
| ***H01H 21/00*** | (2006.01) |
| ***H01H 9/00*** | (2006.01) |
| *H01H 1/16* | (2006.01) |
| *H01H 1/20* | (2006.01) |
| *H01H 3/50* | (2006.01) |

(52) U.S. Cl.

CPC ..... *H01H 9/0016* (2013.01); *H01H 9/0005* (2013.01); *H01H 1/16* (2013.01); *H01H 1/20* (2013.01); *H01H 3/50* (2013.01)

(58) Field of Classification Search

CPC .... H01H 9/0005; H01H 9/0016; H01F 29/02; H01F 30/12; H01F 29/04; G05F 1/14; G05F 1/147

USPC ..... 200/11 TC, 336, 564

See application file for complete search history.

(56) References Cited

U.S. PATENT DOCUMENTS 1,672,686 A * 6/1928 Mertes, Jr. ..... 336/45
7,872,203 B2 * 1/2011 Lindsey et al. ..... 200/11 TC

FOREIGN PATENT DOCUMENTS

CN 2465289 Y 12/2001

* cited by examiner

*Primary Examiner* — Renee S Luebke
*Assistant Examiner* — Lheiren Mae A Caroc
(74) *Attorney, Agent, or Firm* — Tim Tingkang Xia, Esq.; Locke Lord LLP

(57) ABSTRACT

In one aspect of the invention, an off-circuit tap changer includes a switch base and a rotation shaft penetrating the switch base. An upper end of the rotation shaft is connected to an operation positioning device, a lower end of the rotation shaft is disposed with moving contacts, and fixed contacts corresponding to the moving contacts are circumferentially disposed at a spacing on the switch base; the moving contacts are radial elastic rolling moving contacts, and the radial elastic rolling moving contacts span between two adjacent fixed contacts and closely contact the fixed contacts.

10 Claims, 4 Drawing Sheets

OFF-CIRCUIT TAP CHANGER

CROSS-REFERENCE TO RELATED APPLICATION

This application claims the priority to Chinese Patent Application No. CN201210182846.2, filed Jun. 6, 2012, in the State Intellectual Property Office of PR. China, which is hereby incorporated herein in its entirety by reference.

FIELD OF THE INVENTION

The present invention relates to an off-circuit tap changer for a transformer.

BACKGROUND OF THE INVENTION

Chinese Patent No. CN2465289Y discloses a disk-shaped off-circuit tap changer, of which a moving contact is a clip-type structure; two upper and lower moving contacts press a fixed contact with a spring, and when the top changer is shifted, the two upper and lower moving contacts slide and displace on the fixed contact, so as to implement voltage regulations of a transformer. The clip-type moving contact structure has the following shortcomings: sliding friction exists between the moving contact and the fixed contact, and the great frictional resistance not only incurs great operating torque and great contact abrasion, but also has poor handleability during gear shifting; the moving contact has a complicated structure and greatly wastes the materials.

Therefore, a heretofore unaddressed need exists in the art to address the aforementioned deficiencies and inadequacies.

SUMMARY OF THE INVENTION

One of the objectives of the present invention is to provide an off-circuit tap changer with small operating torque, mild contact abrasion, a simple structure, and strong handleability during gear shifting, so as to overcome the shortcomings in the prior art.

In one aspect of the present invention, an off-circuit tap changer includes a switch base and a rotation shaft penetrating the switch base. An upper end of the rotation shaft is connected to an operation positioning device, a lower end of the rotation shaft is disposed with moving contacts, and fixed contacts corresponding to the moving contacts are circumferentially disposed at a spacing on the switch base. The moving contacts are radial elastic rolling moving contacts, and the radial elastic rolling moving contacts span between two adjacent fixed contacts and closely contact the fixed contacts.

In one embodiment, the radial elastic rolling moving contact include a roller moving contact disposed in a stopping cavity of the rotation shaft, a radial elastic pin is arranged at an inner side of the roller moving contact, and an outer side of the roller moving contact fits with the fixed contact.

In another embodiment, the radial elastic rolling moving contact includes a radial elastic pin connected to the rotation shaft, an annular moving contact is sleeved outside the radial elastic pin, an inner ring of the annular moving contact fits with the radial elastic pin, and a periphery of the annular moving contact fits with the fixed contact.

In yet another embodiment, the radial elastic pin includes a pin disposed in a radial pin socket and a spring sleeved outside the pin.

In one embodiment, one to three moving contacts are circumferentially disposed at a spacing around the rotation shaft.

In one embodiment, the fixed contact is fixed or inlaid on the switch base, and a contact face of the fixed contact is a convex arc face.

In one embodiment, one to three sets of fixed contacts are circumferentially disposed on the switch base, and each set includes four to sixteen fixed contacts, and each set of the fixed contacts fits with the corresponding moving contact.

In one embodiment, if one set of moving contacts and one set of fixed contacts exist, a single phase switch structure is formed; and if two or three sets of moving contacts and fixed contacts exist, a multi-phase switch structure or a single phase parallel structure is formed.

In one embodiment, the switch base is a disk-shaped switch base, and the fixed contacts are circumferentially disposed on a bottom surface of the disk-shaped switch base.

The present invention has, among other things, the following beneficial effects: (1). the radial elastic rolling moving contact substitutes for the original clip moving contact, and the rolling friction rather than the sliding friction is generated, so that the operating torque is small and the abrasion of the moving and the fixed contacts is reduced; (2). the handleability is strong, the moving contacts can be automatically homed, the contact pressure is stable, and the contact performance is reliable, thereby avoiding misoperations; and (3). the structure is simple and the manufacturing cost is low. The present invention can be applicable to various small off-circuit tap changers with a central voltage regulation manner or a linear voltage regulation manner, and is generally applied in a disk-shaped switch and also to a cage-shaped switch.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment.

DETAILED DESCRIPTION OF THE INVENTION

Figure 1:
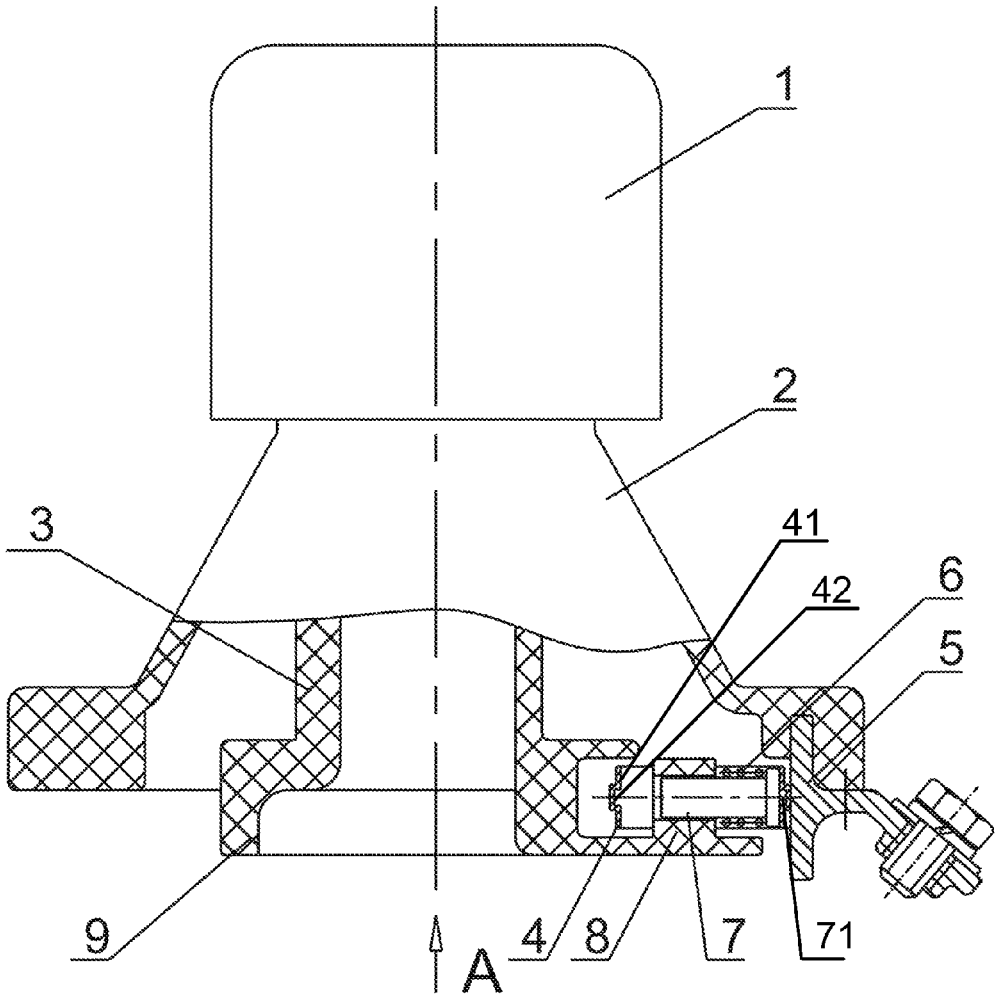
FIG. 1 is a front view of an off-circuit tap changer according to one embodiment of the present invention.

The present invention is more particularly described in the following examples that are intended as illustrative only since numerous modifications and variations therein will be apparent to those skilled in the art. Various embodiments of this invention are now described in detail in conjunction with the accompanying drawings. Referring to the drawings, like numbers indicate like components throughout the views.

In accordance with the purposes of this invention, as embodied and broadly described herein, this invention, in one aspect, relates to an off-circuit tap changer. Two embodiments of the present invention are described below with reference to the accompanying drawings of FIGS. 1-4.

Figure 2:
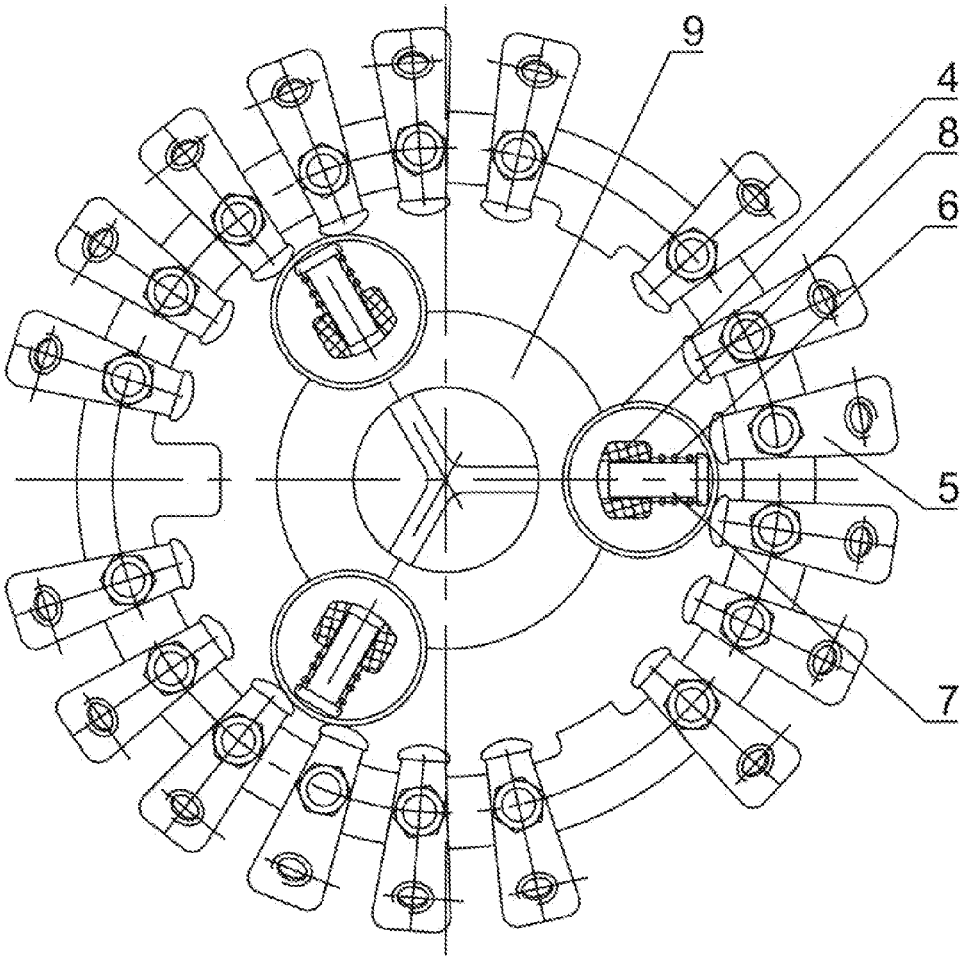
FIG. 2 is an A-direction view of the off-circuit tap changer shown in FIG. 1.

Referring to FIGS. 1 and 2, a three-phase off-circuit disk-shaped tap changer is provided according to one embodiment of the present invention. The three-phase off-circuit disk-shaped tap changer includes a disk-shaped switch base 2 and a rotation shaft 3 penetrating a switch base central hole. An upper end of the rotation shaft is connected to an operation positioning device 1, and a lower end of the rotation shaft 3 is arranged with a drive plate 9 on which three moving contacts are disposed. Each moving contact is a radial elastic rolling moving contact and includes a radial elastic pin connected to the drive plate 9 of the rotation shaft 3, and the radial elastic pin includes a stretchable pin 7 disposed in a pin socket 8 and a spring 6 sleeved outside the pin 7. An annular moving contact 4 surrounds outside the radial elastic pin, an inner annular surface 41 of the annular moving contact 4 fits with the radial elastic pin, an annular groove 42 is arranged on the inner annular surface 41 of the annular moving contact 4 and fits with a flange 71 at a front end of the radial elastic pin, the annular moving contact 4 spans between two adjacent fixed contacts 5, and a periphery of the annular moving contact 4 fits with the two adjacent fixed contacts 5. The fixed contacts 5 are fixed on a bottom surface of the switch base, the corresponding moving contacts 4 are circumferentially disposed at a spacing on the switch base; a contact face of each fixed contact 5 is a convex arc face, and a rear end of the fixed contact 5 is a lead connector. Three sets of the fixed contacts 5, corresponding to the moving contacts 4, are circumferentially disposed on the switch base, and each set includes six fixed contacts 5; and each set of the fixed contacts 5 fits with the corresponding moving contact 4, to form three-phase five-gear tap changer.

Figure 3:
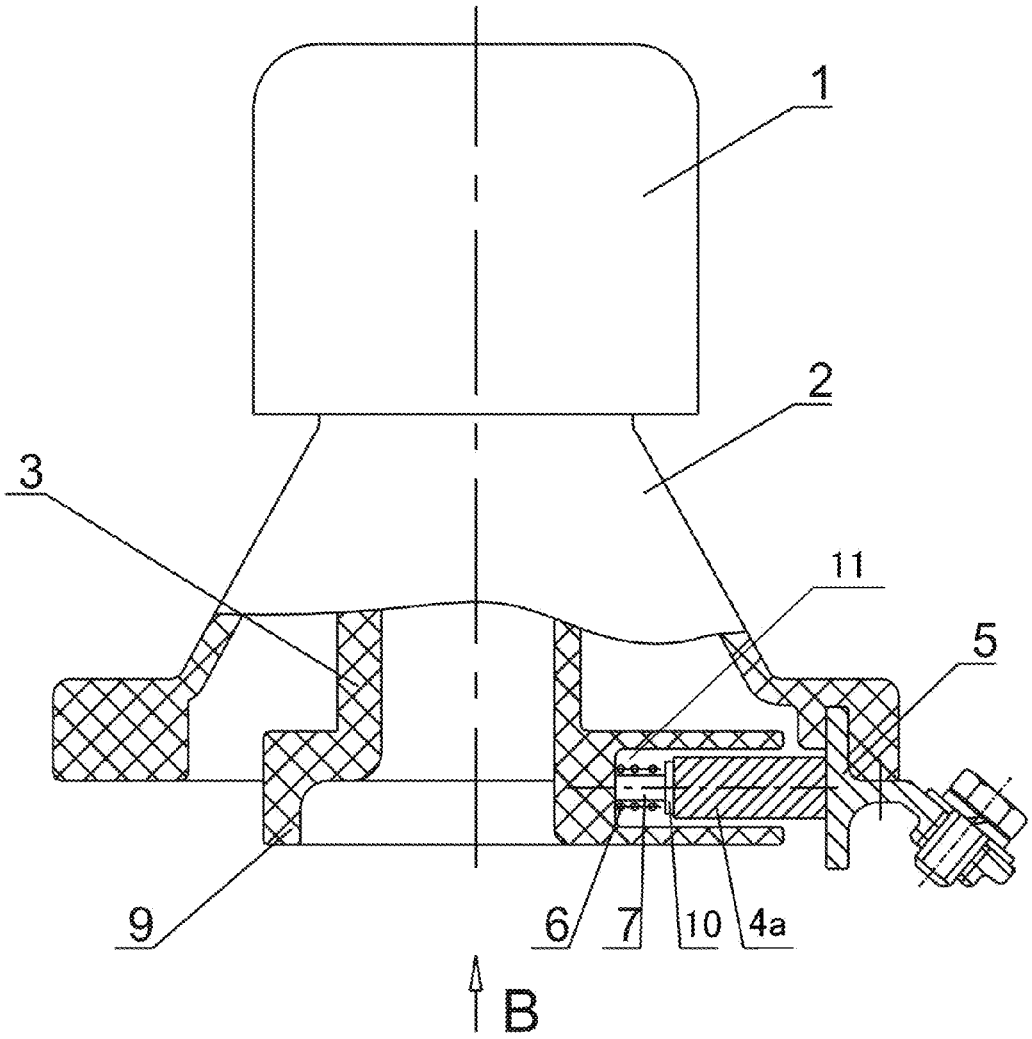
FIG. 3 is a front view of an off-circuit tap changer according to another embodiment of the present invention.
Figure 4:
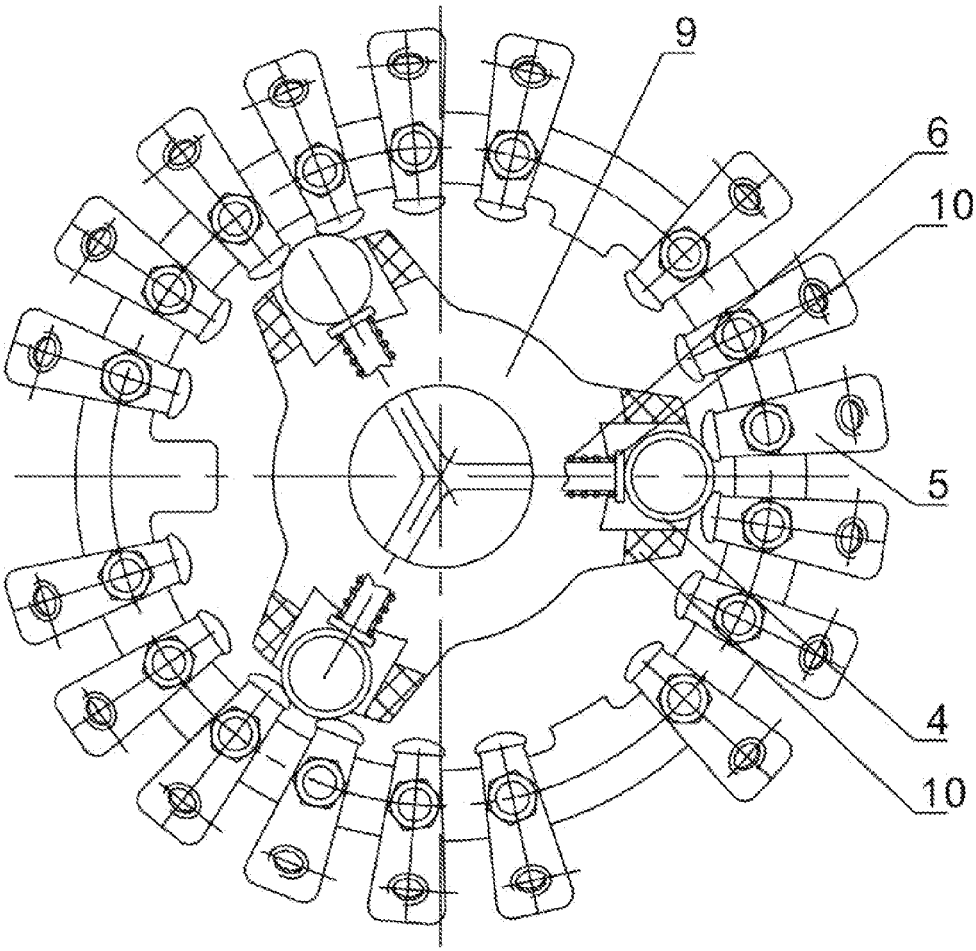
FIG. 4 is a B-direction view of the off-circuit tap changer shown in FIG. 3.

FIGS. 3 and 4 show an off-circuit disk-shaped tap changer according to another embodiment of the present invention. The difference between the off-circuit disk-shaped tap changer of this embodiment and the off-circuit disk-shaped tap changer shown in FIGS. 1 and 2 lies in that, each radial elastic rolling moving contact is in a roller shape. In this embodiment, the off-circuit disk-shaped tap changer includes three roller moving contacts 4*a* disposed in a stopping cavity 11 of a drive plate 9 that is arranged on a lower end of a rotation shaft 3. A radial elastic pin is disposed at an inner side of each roller moving contact 4*a*, and includes a pin 7 disposed in a radial pin socket and a spring 6 sleeved outside the pin 7. A pad 10 is arranged between the pin 7 and the roller moving contact 4*a*, and an outer side of the roller moving contact 4 fits with the two adjacent fixed contacts 5. The roller moving contact 4*a* may also be hollow. Other structures are the same as those in the foregoing embodiment.

The present invention recites, among other things, an off-circuit disk-shaped tap changer having small operating torque, reduced abrasion of the moving and fixed contacts, stable contact pressure and reliable contact performance, a simple structure and low manufacturing cost and, strong handleability, and enabling the moving contacts to automatically home, so that the present invention is applicable to various off-circuit tap changer capable of performing central voltage regulation and linear voltage regulation, and is generally applied in a disk-shaped tap changer and also to a cage-shaped tap changer.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An off-circuit tap changer, comprising:

a switch base; and a rotation shaft penetrating the switch base, wherein an upper end of the rotation shaft is connected to an operation positioning device, a lower end of the rotation shaft is disposed with moving contacts, and fixed contacts corresponding to the moving contacts are circumferentially disposed at a spacing on the switch base; the moving contacts are radial elastic rolling moving contacts, and the radial elastic rolling moving contacts span between two adjacent fixed contacts and closely contact the fixed contacts;

wherein each radial elastic rolling moving contact comprises a roller moving contact disposed in a stopping cavity of the rotation shaft, a radial elastic pin is arranged at an inner side of the roller moving contact, and an outer side of the roller moving contact fits with the fixed contacts; and wherein the radial elastic pin comprises a pin disposed in a radial pin socket and a spring sleeved outside the pin.

2. The off-circuit tap changer according to claim 1, wherein each fixed contact is fixed or inlaid on the switch base, and a contact face of the fixed contact is a convex arc face.

3. The off-circuit tap changer according to claim 1, wherein the switch base is a disk-shaped switch base, and the fixed contacts are circumferentially disposed on a bottom surface of the disk-shaped switch base.

4. The off-circuit tap changer according to claim 1, wherein the moving contacts comprise one to three moving contacts circumferentially disposed at a spacing around the rotation shaft.

5. The off-circuit tap changer according to claim 4, wherein one to three sets of fixed contacts are circumferentially disposed on the switch base, each set comprises four to sixteen fixed contacts, and each set of the fixed contacts fits with the corresponding moving contact.

6. The off-circuit tap changer according to claim 5, wherein if one set of moving contacts and one set of fixed contacts exist, a single phase switch structure is formed; and if two or three sets of moving contacts and fixed contacts exist, a multi-phase switch structure or a single phase parallel structure is formed.

7. An off-circuit tap changer, comprising:

a switch base; and a rotation shaft penetrating the switch base, wherein an upper end of the rotation shaft is connected to an operation positioning device, a lower end of the rotation shaft is disposed with moving contacts, and fixed contacts corresponding to the moving contacts are circumferentially disposed at a spacing on the switch base; the moving contacts are radial elastic rolling moving contacts, and the radial elastic rolling moving contacts span between two adjacent fixed contacts and closely contact the fixed contacts; and wherein each radial elastic rolling moving contact comprises a radial elastic pin connected to the rotation shaft, an annular moving contact surrounds outside the radial elastic pin, an inner annular surface of the annular moving contact fits with the radial elastic pin, and a periphery of the annular moving contact fits with the fixed contacts.

8. The off-circuit tap changer according to claim 7, wherein the radial elastic pin comprises a pin disposed in a radial pin socket and a spring sleeved outside the pin.

9. The off-circuit tap changer according to claim 7, wherein each fixed contact is fixed or inlaid on the switch base, and a contact face of the fixed contact is a convex arc face.

10. The off-circuit tap changer according to claim 7, wherein the switch base is a disk-shaped switch base, and the fixed contacts are circumferentially disposed on a bottom surface of the disk-shaped switch base.

* * * * *